United States Patent [19]

Kimura

[11] Patent Number: 4,956,647

[45] Date of Patent: Sep. 11, 1990

[54] ROD ANTENNA

[75] Inventor: Misao Kimura, Yokosuka, Japan

[73] Assignee: Harada Kogyo Kabushiki Kaisha, Tokyo, Japan

[21] Appl. No.: 762,922

[22] Filed: Aug. 5, 1985

[30] Foreign Application Priority Data

Dec. 10, 1984 [JP] Japan ..... 59-153128[U]

[51] Int. Cl.[5] ..... H01Q 1/10

[52] U.S. Cl. ..... 343/901; 343/715

[58] Field of Search ..... 343/900, 901, 902, 903; 277/30

[56] References Cited

U.S. PATENT DOCUMENTS

| | | | |
|---|---|---|---|
| 2,173,095 | 9/1939 | Byrne | 343/902 |
| 2,914,922 | 12/1959 | Gibson | 343/901 |
| 3,042,416 | 7/1962 | Paluszkiewicz et al. | 277/30 |
| 3,419,876 | 12/1968 | Edwards et al. | 343/901 |
| 3,688,455 | 9/1972 | Zebuhr | 343/902 |
| 4,041,498 | 8/1977 | Freimark et al. | 343/903 |
| 4,137,535 | 1/1979 | Rupprecht | 343/902 |
| 4,353,075 | 10/1982 | Edwards | 343/901 |
| 4,406,469 | 9/1983 | Allison | 277/DIG. 6 |
| 4,542,383 | 9/1985 | Cusey et al. | 343/903 |
| 4,577,872 | 3/1986 | Bake et al. | 277/DIG. 6 |

FOREIGN PATENT DOCUMENTS

| | | | |
|---|---|---|---|
| 1123719 | 2/1962 | Fed. Rep. of Germany | 343/901 |
| 1227092 | 10/1966 | Fed. Rep. of Germany | 343/901 |
| 1161644 | 9/1958 | France | 343/901 |
| 0060550 | 5/1977 | Japan | 343/901 |
| 0060551 | 5/1977 | Japan | 343/901 |
| 54-36613 | 11/1979 | Japan | 343/903 |

*Primary Examiner*—Thomas B. Will

*Attorney, Agent, or Firm*—Koda & Androlia

[57] ABSTRACT

A rod antenna including a plurality of rods of respectively different diameters which are coupled with each other in a manner to be slidable. Each of the larger diameter rods is provided with a rectangular strip of film made of resin such that it is mounted in a ring shape at least at the inside joint area for coupling the larger diameter rod with the smaller diameter rod. The rod antenna can be low in cost since the cutting process done for the conventional antennas is eliminated, and the rectangular film strip is inexpensive and can be easily mounted. Besides, a satisfactory waterproofing can be obtained as the rectangular strip of film is excellent in heat resistance, cold resistance, water repellency, wear resistance, etc. Furthermore, the operating noise of rods during the extension or retraction of the antenna is low and the appearance of the rod can be kept clean.

3 Claims, 2 Drawing Sheets

ROD ANTENNA

BACKGROUND OF THE INVENTION

1. Field of the Invention

The present invention relates to a rod antenna, and more particularly to an extensible rod antenna for automobiles, etc. equipped with waterproofing structure at the joints for respective rods, etc.

2. Description of the Invention

Generally, as shown in FIG. 4, an extensible rod antenna is designed to encase a rod antenna element 1 in a cylindrical housing 2 such that the rod antenna element 1 may be optionally pushed into or pulled out from the cylindrical housing 2. This rod antenna element 1 includes a plurality of rods 1*a*, 1*b*, 1*c* . . . which are respectively different in their diameters and are made of, for example, BST. These rods are coupled to each other in a freely slidable manner. At each of the joints for mutual coupling of the rods of the antenna element 1, waterproofing structures are provided as shown in FIG. 5.

FIG. 5 is an enlarged sectional view of the portion A in FIG. 4 showing a smaller diameter rod 10 and a larger diameter rod 20. The inner circumferential surface at the joint area of the larger diameter rod 20 is processed with a cut-out. In this machined cut-out area, a metal O-ring 23 is seated such that it is inserted and held between first and second collars 21 and 22 which are formed into a ring shape. An open end 24 of the large diameter rod 20 is retracted.

In the conventional rod antenna described above, since the cut-out work needs to be done on the inner surface of the rods, it requires more manufacturing steps, resulting in increasing the cost of the antenna. Besides, the difference in the dimensions of the inside and outside diameters of the antenna rods results in wear due to sliding friction between the O-ring 23 and the smaller diameter rod 10, and along with other factors, it causes watertightness to be lost in a relatively short period of time. Thus, sufficient and long lasting sealing cannot be expected.

Furthermore, if the antenna rods are made of SUS, not only is the material hard in quality, but the rod wall is also in general thin. Thus, cutting work on such a rod is extremely difficult to perform. Due to the above mentioned reason, an alternative is to form a bulged-out portion on the rod coupling area in order to fit the O-ring 23 in this bulged-out portion. However, this method also increases manufacturing steps and the cost of the antenna.

In some cases, in place of the metal O-ring 23, a rubber O-ring is used; however, the rubber O-ring is low in heat resistance as well as abrasion resistance. Thus, it cannot withstand long term use. In an extreme case, the O-ring is forced out of the antenna rod. Accordingly, it has been a practice to use many parts, together with grease seals, etc. in order to accomplish waterproofing.

SUMMARY OF THE INVENTION

In view of the foregoing problems with conventional rod antennas, an object of the present invention is to provide a rod antenna which requires fewer manufacturing steps and a smaller number of parts so that the cost can be reduced substantially.

Another object of the present invention is to provide a rod antenna with a satisfactory sealing effect for waterproofing over a long period of use.

A further object of the present invention is to provide a rod antenna which operates more quietly during extension or retraction of the antenna element.

A still further object of the present invention is to provide a rod antenna wherein the exterior is not likely to be damaged.

In keeping with the principles of this invention, the previously mentioned objects of the present invention are accomplished by a unique structure for a rod antenna including a plurality of antenna rods and sealing strips. The rods with different diameters are coupled to each other in a slidable manner, and the sealing strip which is a rectangular strip of film made of resins such as tetrafluoroethylene resin is mounted on the inner circumferential surfaces of the joint portions of each of the larger diameter rods for securing waterproof.

DETAILED DESCRIPTION OF THE INVENTION

Figure 1:
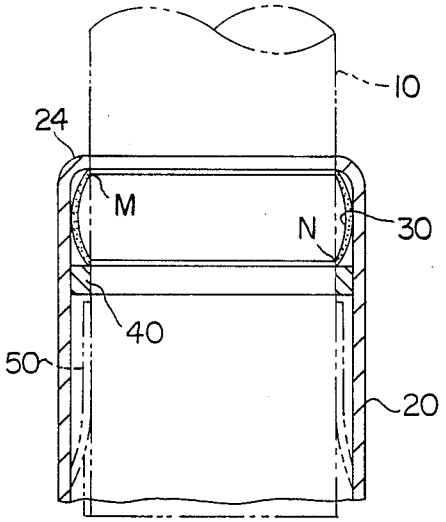
FIG. 1 is a sectional view showing an embodiment of the essential portion of the antenna in accordance with the present invention.
Figure 5:
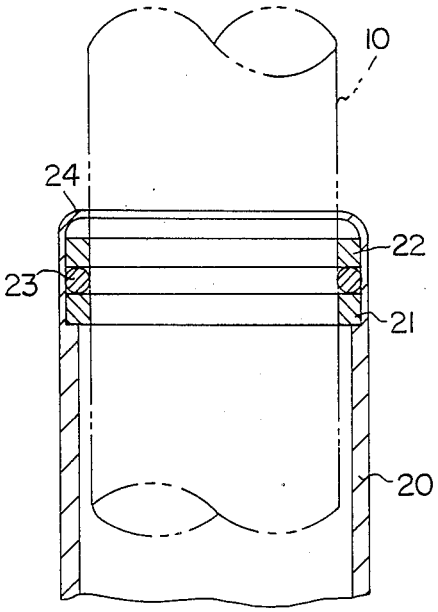
FIG.5 PRIOR ART
FIG. 5 is an enlarged sectional view showing the portion A of FIG. 4.

FIG. 1 shows an embodiment of the present invention, and it is a sectional view of the essential portion corresponding to that shown in FIG. 5. The portions which are the same as those in FIG. 5 are given the same reference numerals with a detailed description omitted.

In FIG. 1, the numeral 30 is a rectangular strip of film made of resins such as tetrafluoroethylene resin. This rectangular film strip 30 is mounted in ring form along the inner circumferential surface of the joint portion of a larger diameter rod 20 of an antenna. A plurality of such rods have respectively different diameters and are coupled with each other in a freely slidable manner. The open end 24 of the larger diameter rod 20 is retracted in advance.

Characteristic properties of the tetrafluoroethylene resin are shown below.

| | |
|---|---|
| "Temperature characteristic" | High Temperature +260 C.<br>Low Temperature −240 C. |
| "Coefficient of water absorption" | 0% |
| "Coefficient of dynamic friction" | 0.12–0.29 |
| "Compressive creep" | 24 hr-10 kg/cm$^2$ |

Figure 2A:
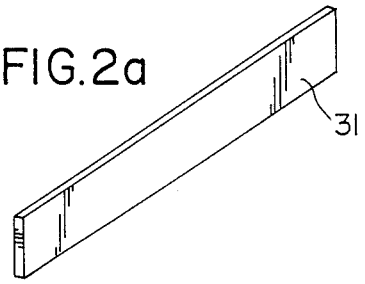
FIGS. 2(*a*) and 2(*b*) are perspective views showing the method for obtaining a rectangular strip of film.
Figure 2B:
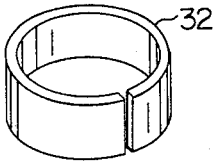

FIGS. 2(*a*) and 2(*b*) show the manner of obtaining the foregoing rectangular film strip 30. This film strip 30 is made of tetrafluoroethylene resin ribbon (not shown in the Figure) which is cut into a specified length, obtaining a rectangular strip of film 31 as shown in FIG. 2(*a*). The rectangular film strip 31 thus obtained is formed into a ring shape piece 32 by rolling it. This ring shape piece 32 is then inserted into the larger diameter rod 20.

As to the above inserting operation, the confirmation was made by the experiment that this operation can be performed easily by using a jig and also that such operation can be readily automated.

Referring back to FIG. 1, a collar 40 is fixed under the rectangular film strip 30 mounted on the inner circumferential surface of the larger diameter rod 20. A smaller diameter rod 10 is inserted from the bottom of the larger diameter rod 20, and an initial load is applied thereto after the smaller diameter rod 10 is pulled out of the open end of the larger diameter rod 20. Then, the collar 40 is pushed upward by the upper end of a working pressure ensuring spring 50 which is attached to the lower end portion of the smaller diameter rod 10. As a result, as shown in the Figure, the rectangular film strip 30 is compressed in the axial direction to be curved. Due to this compressive curving, the upper end edge and the lower end edge of the rectangular film strip 30 come to be in tight contact with the outer circumferential surface of the smaller diameter rod 10, and at the same time, the butt-joint of both ends of the rectangular film strip 30 becomes tightened, thereby shaping this rectangular film strip into a perfect ring form. Thus, a very effective waterproof sealing can be obtained.

The function of the rectangular film strip 30 as mentioned above can be obtained every time the antenna is extended and retracted. Consequently, even if the dimension of the rod diameter, etc. changes over a long period of use, the tight sealing effect can be maintained as such changes occur. Thus, the sealing effect for waterproofing is maintained stably for a long time.

Also, since the rectangular film strip 30 has excellent heat resistance as well as cold resistance, the waterproofing effect is not lost due to changes in ambient temperature. Furthermore, as water absorption of the rectangular film strip is as low as 0%, degradation of the characteristic properties previously mentioned are hardly caused for a long period of time. Moreover, because it is not made of metal, no metallic noise is produced when the antenna is extended and retracted.

Further, since corrosion does not occur, the outer circumference of the antenna rod is not damaged. It is absolutely unnecessary to form the cut-out portion inside the rod; therefore, the antenna of this invention can easily be manufactured. In addition, the rectangular film strip 30 can be applied not only to rods made of BST, but also to rods made of SUS, with no trouble. Furthermore, the rectangular film strip 30 is about 1/30 in cost in comparison with ring shaped seals.

Figure 3:
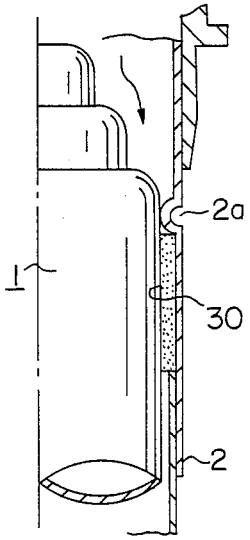
FIG. 3 is a sectional view showing the essential portion of a modified embodiment of the present invention.
Figure 4:
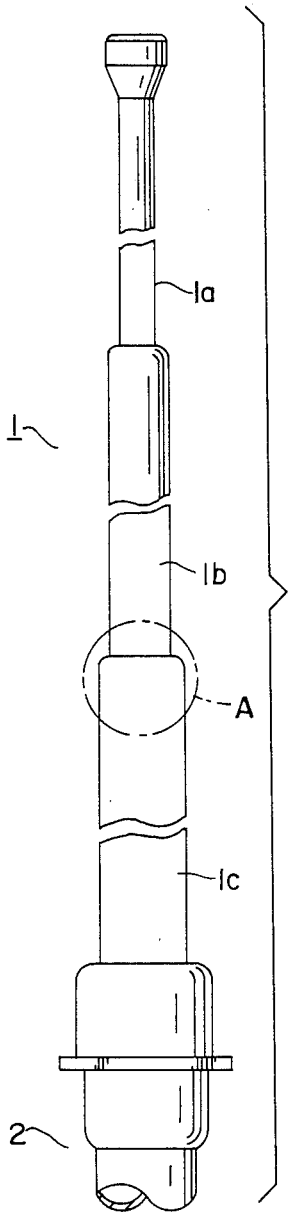
FIG.4 PRIOR ART
FIG. 4 is a front view showing a prior art rod antenna.

The present invention is not limited to the above described embodiment. In the above embodiment, the rectangular film strip 30 is mounted to the inner circumferential surface of the larger diameter rod 20. The rectangular film strip 30 is not limited by only being mounted on the inner circumferential surface of the larger diameter rod 20, but may be mounted on the conductive area of the cylindrical housing 2. Particularly, it may be arranged as illustrated in FIG. 3 such that the rectangular film strip 30 is mounted on the inner circumferential surface of the cylindrical housing 2 in order to stop the rain water, etc. from coming in as shown by the arrow in FIG. 3. In the foregoing embodiment, the collar 40 is provided under the rectangular film strip 30, but this collar 40 may be omitted. Obviously, in addition to those embodiments specifically described above, various changes and modifications may be made within the scope of the present invention.

As should be apparent from the description given above, the rod antenna of this invention includes a plurality of antenna rods and film strips. The rods are respectively of different in diameters and are connected to each other in an optionally slidable manner and a rectangular film strip made of resin, such as tetrafluoroethylene resin, is mounted in a ring form to the inner circumferential surface of the larger diameter rod where the rods are coupled to each other. Therefore, the antenna rod is improved in that: the rods need not to be formed with cut-out, the rectangular film strip is inexpensive and can be easily mounted, manufacturing steps are reduced, the number of parts are reduced and thus the cost of the antenna is lower. Also, resins such as tetrafluoroethylene resin are not only superior in heat resistance, low temperature resistance, water repellency, abrasion resistance, etc., but further effective in absorbing noise with the extra merit of being capable of wiping off dirt. Accordingly, the desirable sealing effect against the water can last for a long time. Furthermore, operating noise of the rods during extension and retraction of the antenna element is low and the appearance of the rods can be maintained less dirty.

I claim:

1. A rod antenna comprising:

an antenna element formed of a plurality of rods which are respectively different in diameters and are coupled to each other in a freely slidable manner; and a rectangular film strip made of resin for forming a waterproof seal between the plurality of rods, the film strip being provided at least at a joint area for coupling the respective rods such that the film strip is mounted in a ring shape onto the inner circumferential surface of each of larger diameter rods, said film strip further being in contact with the inner circumferential surface of respective larger diameter rods and an outer circumferential surface of a respective smaller diameter rod.

2. A rod antenna according to claim 1, wherein the rectangular film strip is made of tetrafluoroethylene resin.

3. A rod antenna according to claim 2, further comprising a means provided on the smaller diameter rod for compressing the film strip in an axial direction thereof causing said film strip to be curved with an upper end edge and a lower end edge of the film strip in contact with the outer circumferential surface of the smaller diameter rod and with a central portion of the curved film strip in contact with the inner circumferential surface of the larger diameter rod when the antenna is extended.

* * * * *